US006650290B1

(12) United States Patent
Chang et al.

(10) Patent No.: US 6,650,290 B1
(45) Date of Patent: Nov. 18, 2003

(54) BROADBAND, LOW LOSS, MODULAR FEED FOR PHASED ARRAY ANTENNAS

(75) Inventors: Li-Chung Chang, Whippany, NJ (US); Norman Gerard Ziesse, Chester, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/630,459

(22) Filed: Aug. 2, 2000

(51) Int. Cl.[7] ..... H01Q 3/26; H01Q 21/00

(52) U.S. Cl. ..... 342/368; 343/369; 343/700; 370/330; 455/430

(58) Field of Search ..... 342/368, 372, 342/373, 157, 374, 80, 154; 343/700, 854, 368, 369, 371, 372, 373; 455/422, 430; 370/330

(56) References Cited

U.S. PATENT DOCUMENTS 4,814,775 A * 3/1989 Raab et al. ..... 342/373
5,367,313 A * 11/1994 Orime et al. ..... 343/853
5,412,414 A 5/1995 Ast et al. ..... 342/174
5,504,466 A 4/1996 Chan-Son-Lint et al. ... 333/159
5,506,589 A * 4/1996 Quan et al. ..... 342/373
5,905,462 A 5/1999 Hampel et al. ..... 342/372
5,940,030 A * 8/1999 Hampel et al. ..... 342/372
6,016,123 A * 1/2000 Barton et al. ..... 342/373

OTHER PUBLICATIONS

IEEE Transactions on Antennas and Propagation; J. Ashkenazy et al., "A Modular Approach for the Design of Microstrip Array Antennas"; vol. AP–31, No. 1, Jan. 1983, pp. 190–193.

R.C. Hansen (ED.); "Phased Array Antennas"; Mar. 8, 1999; Sections 6.2 and 6.3; Fig. 6.4.

IEEE Transactions on Antennas and Propagation; Shashi Sanzgiri et al., "A Hybrid Tile Approach for Ka Band Subarray Modules"; vol. 43, No. 9, Sep. 1995, pp 953–959.

* cited by examiner

*Primary Examiner*—Thomas G. Black
*Assistant Examiner*—Tuan C To

(57) ABSTRACT

In the modular feed for a phased array antenna, the advantages of a series-type feed and a corporate-type feed are combined to increase the system efficiency and the operating bandwidth of the modular feed. Feed modules having a stage of power bifurcation are used to feed array modules having a general series-type feed configuration. The array modules may be interchangeable, and the feed modules may be interchangeable, which decreases production costs and system complexity.

30 Claims, 2 Drawing Sheets

BROADBAND, LOW LOSS, MODULAR FEED FOR PHASED ARRAY ANTENNAS

FIELD OF THE INVENTION

This invention relates to a feed for a phased array antenna. In particular, the invention relates to a modular feed having a wide operating bandwidth, low system loss, and low complexity.

BACKGROUND

The capacity of a wireless system may be increased by using phased array antennas in the base stations servicing a wireless service area. In wireless systems employing phased array antennas, the system loss and operating bandwidth associated with the antenna feed network are critical. A high system loss (or, a low system efficiency) in the feed network results in high power requirements in order for the antenna to broadcast at a certain power level. A narrow operating bandwidth of the feed network results in low bandwidth performance of the antenna.

One conventional class of feed network for phased array antennas is the optical space feed. An optical space feed includes a transmitter for transmitting optical signals to an array of pickup horns. The pickup horns are connected to radiating elements for transmitting signals from the phased array antenna. Optical space feeds suffer the significant disadvantages of occupying a large volume, and of having high system losses.

Another class of antenna feed network is the constrained feed. A first type of constrained feed, the series feed, is illustrated in FIG. 3 of U.S. Pat. No. 5,905,462 to Hampel et al. A series feed has a relatively low system loss. However, the operating bandwidth of a series feed is narrow.

A second type of constrained feed is the parallel feed. Parallel feeds may be rendered frequency independent by the use of delays. However, a parallel feed requires a different phase shifting value at each output branch of the antenna, which becomes difficult to achieve in high gain antennas having many parallel output branches. The differing phase shift values also add to the complexity of parallel feeds.

A third type of constrained feed is the corporate feed. Examples of corporate feeds are illustrated in FIGS. 1 and 2 of Hampel et al. As in parallel feeds, a corporate feed's operating bandwidth may be wide. However, corporate feeds are very complicated, which increases production costs. Corporate feeds also have large system losses because of the multiple bifurcations of the input power supply.

SUMMARY OF THE INVENTION

A need therefore exists for a feed, for a phased array antenna, which has a low system loss, a wide operating bandwidth, and low complexity.

The present invention overcomes the disadvantages of conventional feed configurations by reducing both the transmission line length and the number of stages of power bifurcation, which increases the efficiency of the modular feed.

An embodiment of the present invention is a modular feed for a phased array antenna, the modular feed comprising separate modules. A first type of module in the modular feed, the array module, has a series-type feed configuration and thus includes a plurality of radiating element feed lines for connection with radiating elements. A second type of module, the feed module, includes circuitry for feeding signals to a plurality of the array modules. In an exemplary embodiment, a power divider feeds two feed modules, each feed module feeds two array modules, and each array module includes four radiating element feed lines. The use of feed modules to feed the array modules having a series-type feed configuration reduces transmission line length and requires only two stages of power bifurcation.

The array modules may be interchangeable, which decreases the complexity and production costs of the modular feed. The feed modules may also be interchangeable, further decreasing the complexity and cost of the modular feed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
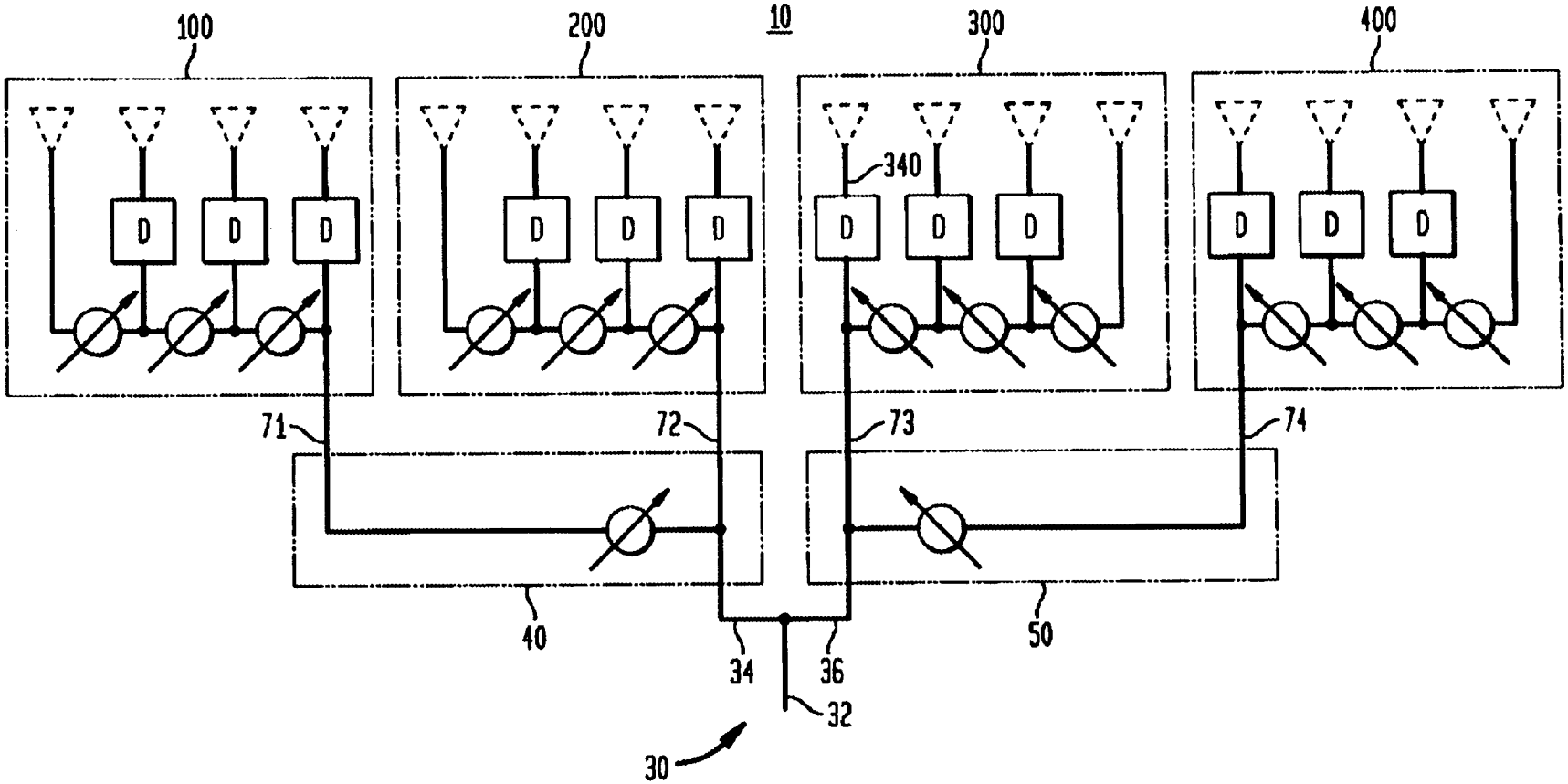
FIG. 1 is a schematic diagram of a modular feed according to one embodiment of the present invention.

FIG. 1 illustrates a modular feed according to one embodiment of the present invention. As shown in FIG. 1, a modular feed 10 for a phased array antenna is comprised of a first feed module 40 connected to first and second array modules 100, 200 by transmission lines 71, 72, respectively, a second feed module 50 connected to third and fourth array modules 300, 400 by transmission lines 73, 74, respectively, and a power divider 30 connected to the first and second feed modules 40, 50.

The power divider 30 has an input line 32 that may receive signals from, for example, hardware within a base station. The power divider 30 bifurcates a signal along output lines 34 and 36, which are connected to the first and second feed modules 40, 50, respectively. Because the modular feed 10 is symmetric with respect to the power divider 30, the structure of the present invention will be discussed with reference to the left side of the modular feed 10, comprising the first feed module 40, the transmission lines 71, 72, and the first and second array modules 100, 200.

Figure 2:
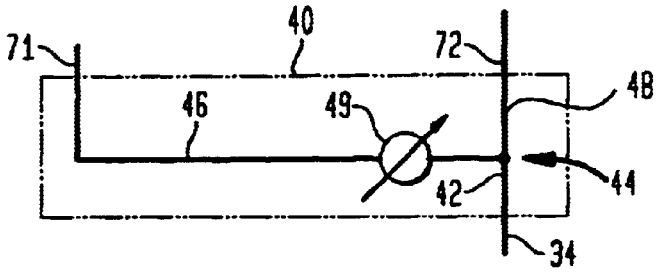
FIG. 2 is a schematic diagram of a feed module according to one embodiment of the present invention.

FIG. 2 illustrates the first feed module 40. The output line 34 of the power divider 30 is connected to an input line 42 of a power divider 44 in the first feed module 40. The power divider 44 bifurcates a signal along an output line 46 and an output line 48. A phase shifter 49 is disposed in the output line 46. The transmission line 72 connects the output line 48 to the second array module 200, and the transmission line 71 connects the output line 46 to the first array module 100.

Figure 3:
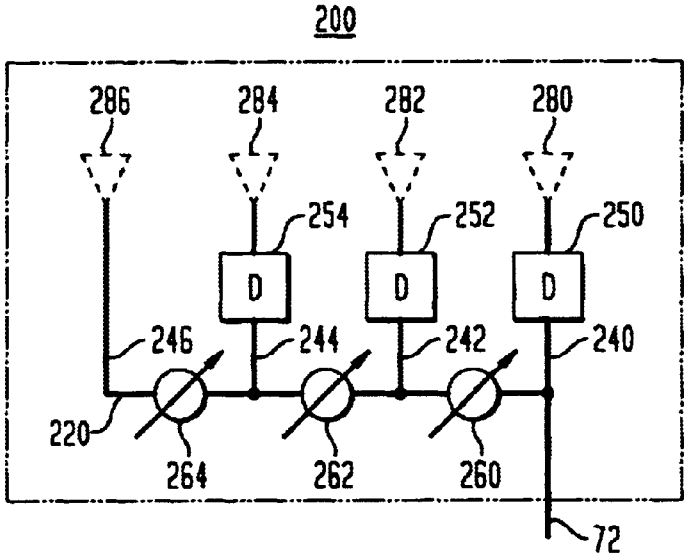
FIG. 3 is a schematic diagram of an array module according to one embodiment of the present invention.

FIG. 3 illustrates the second array module 200. The transmission line 72 is connected to an array feed line 220 of the second array module 200. First through fourth radiating element feed lines 240, 242, 244, 246 are connected, in parallel to one another, to the array feed line 220. The first through fourth radiating element feed lines 240, 242, 244, 246 each have a respective one of first through fourth radiating elements 280, 282, 284, 286 (shown in the figures in phantom) connected to a terminal end.

The second array module 200 includes first through third phase shifters 260, 262, 264 to compensate for the distances between the first through fourth radiating elements 280, 282, 284, 286, and to allow for steering of an antenna utilizing the modular feed 10. The first phase shifter 260 is disposed in the array feed line 220 between the first radiating element feed line 240 and the second radiating element feed line 242, the second phase shifter 262 is disposed in the array feed line 220 between the second radiating element feed line 242 and the third radiating element feed line 244, and the third phase shifter 264 is disposed in the array feed line 220 between the third radiating element feed line 244 and the fourth radiating element feed line 246. The second array module 200 therefore has a general series feed configuration.

In addition, the second array module 200 includes first through third delays 250, 252, 254 to ensure that a signal arriving from the transmission line 72 reaches the first through fourth radiating elements 280, 282, 284, 286 at the same time, or at nearly the same time. The first radiating element feed line 240 includes the first delay 250, which delays signals in the first radiating element feed line 240 for a specified time period, the second radiating element feed line 242 includes the second delay 252 of a lesser delay period than the first delay 250, and the third radiating element feed line 244 includes the third delay 254 of a lesser delay period than the delay 252.

Figure 4:
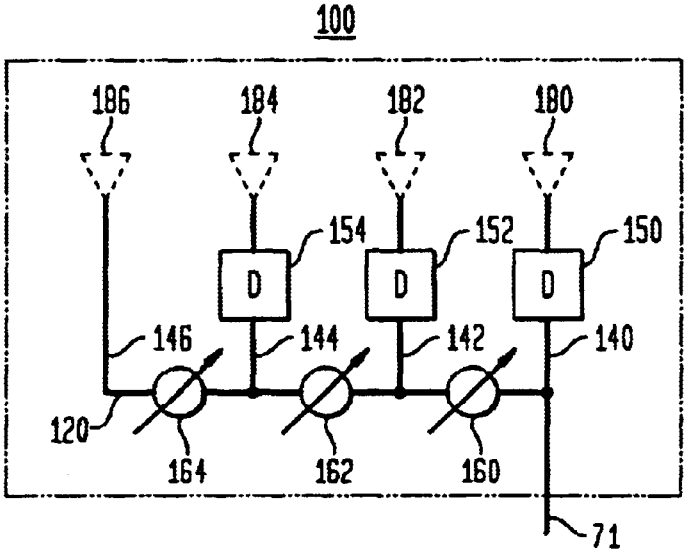
FIG. 4 is a schematic diagram of an array module according to one embodiment of the present invention.

The first array module 100 shown in FIG. 4 has the same structure as that of the second array module 200, and therefore will not be discussed in detail.

The first through fourth array modules 100, 200, 300, 400 may be separate, individual modules. For example, the first array module 100 may comprise a circuit board, with the array feed line 120, the first through third delays, 150, 152, 154, and the remaining array module circuitry, formed thereon. The first through fourth radiating elements 180, 182, 184, 186 need not be formed as part of the first array module 100, and can be detachably engaged with the first through fourth radiating element feed lines 140, 142, 144, 146. The second through fourth array modules 200, 300, 400 may be similarly formed.

Each of the first through fourth array modules 100, 200, 300, 400 may include an interface for connection to a transmission line 71, 72, 73, 74, respectively. Alternatively, the first through fourth array modules 100, 200, 300, 400 may include interfaces for direct connection to one of the first and second feed modules 40, 50. Both types of interfaces may be included for increased versatility of the first through fourth array modules 100, 200, 300, 400.

The first and second feed modules 40, 50 may also comprise circuit boards, with feed module circuitry included thereon. The first and second feed modules 40, 50 may contain interfaces for connection with the transmission lines 71, 72, 73, 74, interfaces for direct connection to the first through fourth array modules 100, 200, 300, 400, or both types of interfaces. The first and second feed modules 40, 50 also include interfaces for connection with the power divider 30.

As shown in FIGS. 1, 3 and 4, each of the first through fourth array modules 100, 200, 300, 400 may be identical. In FIG. 1, the third and fourth array modules 300, 400 are identical to the first and second array modules 100, 200, but are arranged in the modular feed 10 in differing physical orientations. By flipping an array module over, the array module may be used on either the left or the right side of the modular feed 10. For example, the first array module 100 is interchangeable with the third and fourth array modules 300, 400, by flipping the first array module 100 over. The second array module 200 is also interchangeable with the third and fourth array modules 300, 400. Similarly, the first and second feed modules 40 and 50 may be identical, and interchangeable.

By using identical, interchangeable first through fourth array modules 100, 200, 300, 400, the complexity of the modular feed 10 is considerably reduced. In the exemplary embodiment, only one type of array module and one type of feed module are required to construct a feed for a phased array antenna.

The operation of the modular feed 10 will now be discussed with reference to FIGS. 1–4.

Referring to FIG. 1, signals are fed to the modular feed 10 at the input line 32. The signals are divided among the output lines 34 and 36.

Referring to FIG. 2, signals from the output line 34 are received by the input line 42 of the feed module 40. These signals are in turn divided at the power divider 44 and sent to the output lines 46 and 48. The phase shifter 49 shifts the phase of signals sent along the output line 46. The operation of the phase shifter 49 will be discussed in greater detail below in relation to the discussion of the operation of the phase shifters in the array modules.

Referring to FIG. 3, signals from the output line 48 are transmitted over the transmission line 72 to the array feed line 220 of the second array module 200. A portion of the signals in the transmission line 72 are also taken off into the first radiating element feed line 240. The signals in the first radiating element feed line 240 are delayed for a period of time in the first delay 250 before reaching the first radiating element 280.

The array feed line 220 conveys the remaining portions of the signals in the transmission line 72 to the second through fourth radiating element feed lines 242, 244, 246. Each of the first through third phase shifters 260, 262, 264 shifts the phases of signals in the array feed line 220, with respect to the phases of signals in the first radiating element feed line 240, by a phase shift angle $\Delta\phi$. Therefore, the phases of signals in the second radiating element feed line 242 are shifted by $\Delta\phi$, the phases of signals in the third radiating element feed line 244 are shifted by $2\Delta\phi$, and the phases of signals in the fourth radiating element feed line 246 are shifted by $3\Delta\phi$. The phase shift in the third radiating element feed line 244 is larger than the phase shift in the second radiating element feed line 242, and accounts for the larger distance between the third radiating element feed line 244 and the first radiating element feed line 240. Accordingly, the phase shift of $3\Delta\phi$ in the fourth radiating element feed line 246 is the largest in the second array module 200.

The delay period of the first delay 250 is longer than that of the second delay 252, with the third delay 254 having the shortest delay period. The first through third delays 250, 252, 254 are included to ensure that a signal arriving from the transmission line 72 reaches the first through fourth radiating elements 280, 282, 284, 286 at the same time, or at nearly the same time.

Referring to FIG. 2, the phase shifter 49 shifts the phases of signals in the output line 46, which are then sent to the first array module 100. Generally, each of the first through fourth array modules 100, 200, 300, 400 may include n radiating element feed lines. The phase shifter 49 must shift the phase of the signals sent to the array module 100 to account for the distance of the first array module 100 from the first radiating element feed line 240 in the array module 200. The phase shift imposed by the phase shifter 49 is thus nΔø. In the embodiment illustrated in FIGS. 1–4, in which each of the first through fourth array modules 100, 200, 300, 400 has four radiating element feed lines, the phase shift imposed by the phase shifter 49 is 4Δø. The transmission line 71 conveys the signals shifted by the phase shifter 49 to the first array module 100.

Referring to FIG. 4, signals in the transmission line 71 arrive at the array feed line 120, and at the first radiating element feed line 140, shifted in phase by 4Δø (or, more generally, nΔø), with respect to signals in the first radiating element feed line 240 in the second array module 200. The phase shift of 4Δø and the phase shifts imposed by the first through third phase shifters 160, 162, 164 shift the phases of signals in the first through third radiating element feed lines 142, 144, 146 as follows: the second radiating element feed line 142 by 5Δø; the third radiating element feed line 144 by 6Δø; and, the fourth radiating element feed line 146 by 7Δø.

Referring to FIG. 1, the right side of the modular feed 10 operates in a manner similar to the left side of the modular feed 10. Because the third and fourth array modules 300, 400 are flipped with respect to the first and second array modules 100, 200, and because the second feed module 50 is flipped with respect to the first feed module 40, the phase shifts imposed by the phase shifters in the right side of the feed module 10 are negative in sign.

Because the modular feed 10 is symmetric, the phases of signals in the first radiating element feed line 340 in the third array module 300 are not shifted with respect to signals in the first radiating element feed line 240 in the second array module 200. However, the phases of signals in successive radiating element feed lines in the right side of the modular feed 10 (outward from the center of the modular feed 10) are shifted by −Δø, −2Δø, −3Δø, −4Δø, −5Δø, −6Δø, and −7Δø, in the exemplary embodiment.

Next, the operation of the delays in the feed lines will be discussed. The delays employed in the first through fourth array modules 100, 200, 300, 400 increase the operating bandwidth of the modular feed 10. However, the delays need not precisely compensate for the time required by signals to travel between respective radiation element feed lines (i.e., the configuration which yields an unlimited operating bandwidth, or frequency independence, for the modular feed 10). If the delays are designed to perfectly compensate for this travel time, the power requirements of the modular feed 10 may be unnecessarily high.

Each delay may have a lesser delay than that which renders the phased array antenna 10 frequency independent. This is an important practical consideration, because an unlimited operating bandwidth may not be required for the modular feed 10. The delays in the first through fourth array modules 100, 200, 300, 400 may instead be designed to provide a desirable, limited operating bandwidth for the modular feed 10. In this manner, the delays may be considerably shortened, reducing the power requirements of the modular feed 10.

The exemplary embodiment shown in the figures has a high system efficiency. The use of first and second feed modules 40 and 50 to feed the first through fourth array modules 100, 200, 300, 400 allows a relatively short line length to be employed. As shown in FIG. 1, the modular feed 10 requires only two stages of power bifurcation (one stage at the power divider 30, and a second stage at the power dividers in the first and second feed modules 40, 50) to feed 16 radiating elements. By contrast, a pure corporate feed would require four stages of bifurcation to feed 16 radiating elements. Bifurcations are undesirable, because each stage of bifurcation increases the power requirements of a feed.

The first and second feed modules 40, 50 are advantageously combined with the first through fourth array modules 100, 200, 300, 400, which have a general series-type feed structure. Because the modular feed 10 includes multiple array modules, each array module need not include an excessive number of radiating element feed lines.

In addition to the above advantages, the frequency dependence of the first through fourth array modules 100, 200, 300, 400 can be reduced by the use of delays in the radiating element feed lines. The modular feed 10 therefore has a wide operating bandwidth in addition to increased system efficiency.

The modular feed 10 illustrated in FIG. 1 includes first through fourth array modules 100, 200, 300, 400, in a symmetric configuration. This configuration is utilized for the purposes of illustration, and it should be understood that the modular feed 10 need not include four identical array modules, as shown in the figures.

In FIG. 1, an exemplary value of four radiating elements feed lines is shown as comprising each array module. This number is used for the purpose of illustration, and should not be considered limitative of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A feed for an antenna comprising:

a first power divider having an input line and first and second output lines;

a second power divider having an input line, connected to the first output line of the first power divider, and at least two output lines;

a third power divider having an input line, connected to the second output line of the first power divider, and at least two output lines; and four array feeds, each array feed being connected to one of the output lines of the second and third power dividers, each array feed including, an array feed line, and at least two radiating element feed lines connected to the array feed line, each of the radiating element feed lines for feeding a radiating element;

wherein, for each of said second and third power dividers, a first output line includes at least one different component type than a second output line so as to make said second and third power dividers symmetric, and wherein a layout of said third power divider is arranged as a mirror image of a layout of said second power divider.

2. The feed for an antenna of claim 1, further comprising:

a phase shifter for shifting the phase of signals in one of the output lines of the second power divider; and a phase shifter for shifting the phase of signals in one of the output lines of the third power divider.

3. The feed for an antenna of claim 1, wherein each array feed includes:

at least three radiating element feed lines; and at least two array phase shifters disposed in the array feed line, a first array phase shifter being disposed between a first and second of the three radiating element feed lines, and a second array phase shifter being disposed between the second and third radiating element feed lines.

4. The feed for an antenna of claim 1, wherein at least one of the radiating element feed lines includes a delay.

5. The feed for an antenna of claim 1, wherein said input line of said first power divider defines a line of symmetry for said second and third power dividers.

6. A feed for an antenna comprising:

a first power divider having an input line and first and second output lines;

a second power divider having an input line, connected to the first output line of the first power divider, and at least two output lines;

a third power divider having an input line, connected to the second output line of the first power divider, and at least two output lines; and four array feeds, each array feed being connected to one of the output lines of the second and third power dividers, each array feed including, an array feed line, and at least two radiating element feed lines connected to the array feed line, each of the radiating element feed lines for feeding a radiating element;

wherein a phase shifter for shifting the phase of signals in one of the output lines of the second power divider shifts the phase of a signal by $n\Delta\phi$, where n is the number of radiating element feed lines in an array feed, and $\Delta\phi$ is a phase shift angle.

7. The feed for an antenna of claim 6, wherein the phase shifter for shifting the phase of signals in one of the output lines of the third power divider shifts the phase of a signal by $n\Delta\phi$.

8. The feed for an antenna of claim 7, wherein n is at least three.

9. The feed for an antenna of claim 8, wherein each array feed includes two array phase shifters disposed in the array feed line, a first array phase shifter being disposed between a first and second of the three radiating element feed lines, and a second array phase shifter being disposed between the second and third radiating element feed lines.

10. The feed for an antenna of claim 9, wherein each array phase shifter shifts the phase of a signal by $\Delta\phi$.

11. The feed for an antenna of claim 6, wherein n is at least three.

12. The feed for an antenna of claim 11, wherein each array feed includes two array phase shifters disposed in the array feed line, a first array phase shifter being disposed between a first and second of the three radiating element feed lines, and a second array phase shifter being disposed between the second and third radiating element feed lines.

13. The feed for an antenna of claim 12, wherein each array phase shifter shifts the phase of a signal by $\Delta\phi$.

14. A modular feed for an antenna comprising:

a plurality of feed modules, each feed module having an input line, a non-phase-shifted output line, and at least one phase-shifted output line; and a plurality of array modules, each array module being connected to one of the output lines of one of the feed modules, each array module including, an array feed line, and a plurality of radiating element feed lines connected to the array feed line;

wherein components in each of the array modules are arranged symmetrically; and wherein the array modules are symmetrically interchangeable.

15. The modular feed of claim 14, wherein the feed modules are interchangeable.

16. The modular feed of claim 14, wherein the array modules are connected to a respective output line by a transmission line.

17. The modular feed of claim 14, wherein the array modules each comprise a circuit board.

18. The modular feed of claim 14, wherein the feed modules each comprise a circuit board.

19. The modular feed of claim 14, wherein components in each of the feed modules are arranged symmetrically.

20. A modular feed for an antenna comprising:

a plurality of feed modules, each feed module having an input line and at least two output lines; and a plurality of array modules, each array module being connected to one of the output lines of one of the feed modules, each array module including, an array feed line, and a plurality of radiating element feed lines connected to the array feed line;

wherein each feed module includes a non-phase-shifted output line and at least one phase-shifted output line.

21. The modular feed of claim 20, wherein the phase shifters shift the phase of signals by $n\Delta\phi$, where n is the number of radiating element feed lines in an array module, and $\Delta\phi$ is a phase shift angle.

22. The modular feed of claim 21, wherein the array modules are interchangeable.

23. The modular feed of claim 21, wherein the feed modules are interchangeable.

24. The modular feed of claim 21, wherein n is at least three.

25. The modular feed of claim 24, wherein each array module includes two array phase shifters disposed in the array feed line, a first array phase shifter being disposed between a first and second of the three radiating element feed lines, and a second array phase shifter being disposed between the second and third radiating element feed lines.

26. The modular feed of claim 25, wherein each array phase shifter shifts the phase of a signal by $\Delta\phi$.

27. The modular feed of claim 21, wherein the array modules are interchangeable, and the feed modules are interchangeable.

28. The modular feed of claim 20, wherein each array feed includes:

at least three radiating element feed lines; and at least two array phase shifters disposed in the array feed line, a first array phase shifter being disposed between a first and second of the three radiating element feed lines, and a second array phase shifter being disposed between the second and third radiating element feed lines.

29. The modular feed of claim 28, wherein the array modules are interchangeable.

30. The modular feed of claim 28, wherein the feed modules are interchangeable.

* * * * *